US006918996B2

(12) United States Patent
Hasanen et al.

(10) Patent No.: US 6,918,996 B2
(45) Date of Patent: Jul. 19, 2005

(54) METHOD AND APPARATUS IN ROPELESS TAIL THREADING IN A MULTI-ROLL CALENDER

(75) Inventors: Kari Hasanen, Kerava (FI); Juha Laitio, Espoo (FI); Mika Viljanmaa, Helsinki (FI)

(73) Assignee: Metso Paper, Inc., Helsinki (FI)

( * ) Notice: Subject to any disclaimer, the term of this patent is extended or adjusted under 35 U.S.C. 154(b) by 19 days.

(21) Appl. No.: 10/444,667

(22) Filed: May 23, 2003

(65) Prior Publication Data

US 2003/0221809 A1 Dec. 4, 2003

(30) Foreign Application Priority Data

May 28, 2002 (FI) ..... 20025027

(51) Int. Cl.[7] ..... D21F 7/00; D21G 9/00

(52) U.S. Cl. ..... 162/193; 162/191; 162/194; 162/264; 162/286; 226/91

(58) Field of Search ..... 162/189–191, 162/193, 194, 205, 206, 199, 289, 272, 286, 361, 255, 260; 226/91, 92; 83/23–28, 53, 56, 614; 100/162 R, 163 A, 166, 173, 328–331, 35–38, 47

(56) References Cited

U.S. PATENT DOCUMENTS 2,755,711 A * 7/1956 Moore ..... 100/166
5,784,955 A * 7/1998 Conrad ..... 100/329
2002/0060001 A1 5/2002 Conrad et al.

FOREIGN PATENT DOCUMENTS

| | | |
|---|---|---|
| FI | 83795 | 8/1991 |
| FI | 88184 | 5/1993 |
| FI | 88185 | 5/1993 |
| FI | 101634 | 7/1998 |
| FI | 102093 | 10/1998 |
| FI | 108056 | 11/2001 |
| FI | 108057 | 11/2001 |
| FI | 108739 | 3/2002 |

* cited by examiner

*Primary Examiner*—Eric Hug
(74) *Attorney, Agent, or Firm*—Fildes & Outland, P.C.

(57) ABSTRACT

A method and apparatus in ropeless tail threading in a multi-roll calender is disclosed wherein the threading tail is guided through the multi-roll calender in such a way that, before the multi-roll calender, the threading tail is guided first of all to the broke processing and then cut when the tail threading begins. The tail threading takes place in stages, so that at least once during the tail threading the threading tail in connection with the multi-roll calender is guided to broke processing and cut, after which the tail threading is continued, once the previous stage has succeeded.

11 Claims, 5 Drawing Sheets

METHOD AND APPARATUS IN ROPELESS TAIL THREADING IN A MULTI-ROLL CALENDER

FIELD OF THE INVENTION

The present invention relates to a method and apparatus in ropeless tail threading in a multi-roll calender, in which the web threading tail is guided through the multi-roll calender in such a way that, before the multi-roll calender, the web threading tail is guided first of all to the broke processing and then cut when the tail threading begins.

BACKGROUND OF THE INVENTION

Multi-roll calenders are used in the finishing of the paper web, either in connection with the paper machine (ON-line) or separately from the paper machine (OFF-line). A multi-roll calender is formed of several rolls set on top of each other, the surfaces of which are alternately hard and soft.

Particularly precisely in ON-line calenders, the tail-threading procedure takes place at the running speed of the paper machine, which nowadays is already nearly 2000 meters a minute. This makes demands on the success of the tail threading, which have been attempted to be resolved in several different ways.

Solutions are known, in which a tail threading rope is used to guide the threading tail through the set of rolls. Besides rope threading, various kinds of air blows can be used as an aid. As is known, rope threading is, however, a way of threading the tail that is uncertain, has a limited threading path, and is even questionable in terms of work safety, especially at high speeds, which has led to attempts to develop more advance solutions in stead of it.

U.S. Pat. No. 6,245,198 discloses suction boxes to be used along with a tail-threading belt, which are set in the free spaces between the calender rolls and the web take-off rolls. The suction boxes are used to support the web against the tail-threading belt.

Another example of the prior art is represented by the pulling nip arrangement disclosed in utility model FI-4362. In this, the web threading tail is taken, in the first sequence, using rope threading, through the calender nips, to a point preceding the lowest nip, in which a so-called pulling nip is arranged in connection with the web take-off roll. After the pulling nip, the paper web is led down to broke processing. When moving to the second sequence, an intermediate cut is made after the pulling nip, after which the threading tail is guided through the last roll nip and on, for example, to a reeler. In this arrangement, however, the suction belt preceding the cutting point, i.e. the holding point of the web threading tail, is disadvantageously far away. This causes slack after the holding point at the moment of cutting which can break. In addition, the functionality of such an arrangement sets an upper speed limit of less than 2000 meters a minute.

FI publication 20001965 discloses a solution for closing the tail threading of a multi-roll calender. In it, the web is supported between the roll of the calender and the take-off roll by at least one means of a shut-off element not extending through nip. The shut-off element permits tail threading without separate devices in the roll stack. The solution also permits tail threading that proceeds in stages and covers the full web width. Using such ropeless supported threading, speeds of considerably more than 2000 meters a minute can already been achieved.

Further, tail-threading methods arranged using suction belts are also known, and can be exploited in, for example, the solution disclosed in the utility model FI-4362. In practice, however, their functionality is limited by complicated threading geometries, which cause the tail to peel off the belt as it proceeds. A peeled-off double tail is then formed, which significantly hampers the tail threading, and finally prevents it altogether.

Further, despite even the more developed tail threading solutions described above, the ropeless tail threading process is typically hampered in multi-roll calenders by the increase in the threading distance, changes in the direction of travel of the threading tail (to a greater extent the larger the change in direction), and the threading through open roll nips.

SUMMARY OF THE INVENTION

The present invention is intended to create a method and apparatus in ropeless tail threading in a multi-roll calender, by means of which considerably more reliable tail threading than the known tail threading can be achieved.

Accordingly a method in ropeless tail threading in a multi-roll calender, in which the threading tail is guided through the multi-roll calender in such a way that, before the multi-roll calender, the threading tail is guided first of all to the broke processing and then cut when the tail threading begins, is characterized in that the tail threading takes place in stages, so that at least once during the tail threading the threading tail in connection with the multi-roll calender is guided to broke processing and cut, after which the tail threading is continued, once the previous stage has succeeded.

According to the invention the apparatus in ropeless tail threading in a multi-roll calender, which apparatus includes ropeless tail threading elements for guiding the threading tail through the nips formed by the rolls of the multi-roll calender, and to which tail threading elements the threading tail is arranged to be guided from the previous tail threading elements of the multi-roll calender, and by means of which tail threading elements the threading tail is arranged to be guided to the following tail threading elements of the multi-roll calender, is characterized in that the apparatus further includes at least one cutting device arranged in connection with the multi-roll calender before the last nip, for cutting the threading tail and for terminating the tail threading stage in question, and after which cutting device the following tail threading element of the apparatus is arranged.

In the method according to the invention, tail threading in a multi-roll calender is carried out in stages. During tail threading in connection with a multi-roll calender, the web threading tail is cut at least once. After this, tail threading is continued once the previous stage has succeeded.

Further, in the apparatus according to the invention, at least one cutting device for cutting the web threading tail, and for terminating the tail threading stage in question, is arranged in connection with the multi-roll calender. After the cutting device, the following tail threading element of the apparatus is arranged, and can be, for example, suction belts and/or blower, threading, and/or guide plates.

In the method according to the invention, intermediate cutting is used to remove the double tail of the threading tail, after which threading can continue without problems. One difference from the prior art is a tail threading element that acts as a holding point for the web threading tail, and which is located immediately before the cutting point. In this way, slack cannot form in the web.

Further, an additional advantage achieved is the efficiency brought by automation to the tail threading that is divided into stages, thus substantially reducing the amount of broke and, in the best case, eliminating it entirely. In addition, the tail threading method according to the invention advantageously permits the creation of a recovery function, so that, if the tail threading stage being carried out fails, a new attempt can be initiated from the previous successful stage, and not, for example, from the tail threading point preceding the multi-roll calender, as is now done in the prior art. Also the tail threading paths can be varied to a considerably greater extent and more easily than in the prior art.

These and other features and advantages of the invention will be more fully understood from the following detailed description of the invention taken together with the accompanying drawings.

DETAILED DESCRIPTION OF THE INVENTION

In the following, the method and apparatus according to the invention are described as individual example of embodiments in a multi-roll calender 10.

Figure 1:
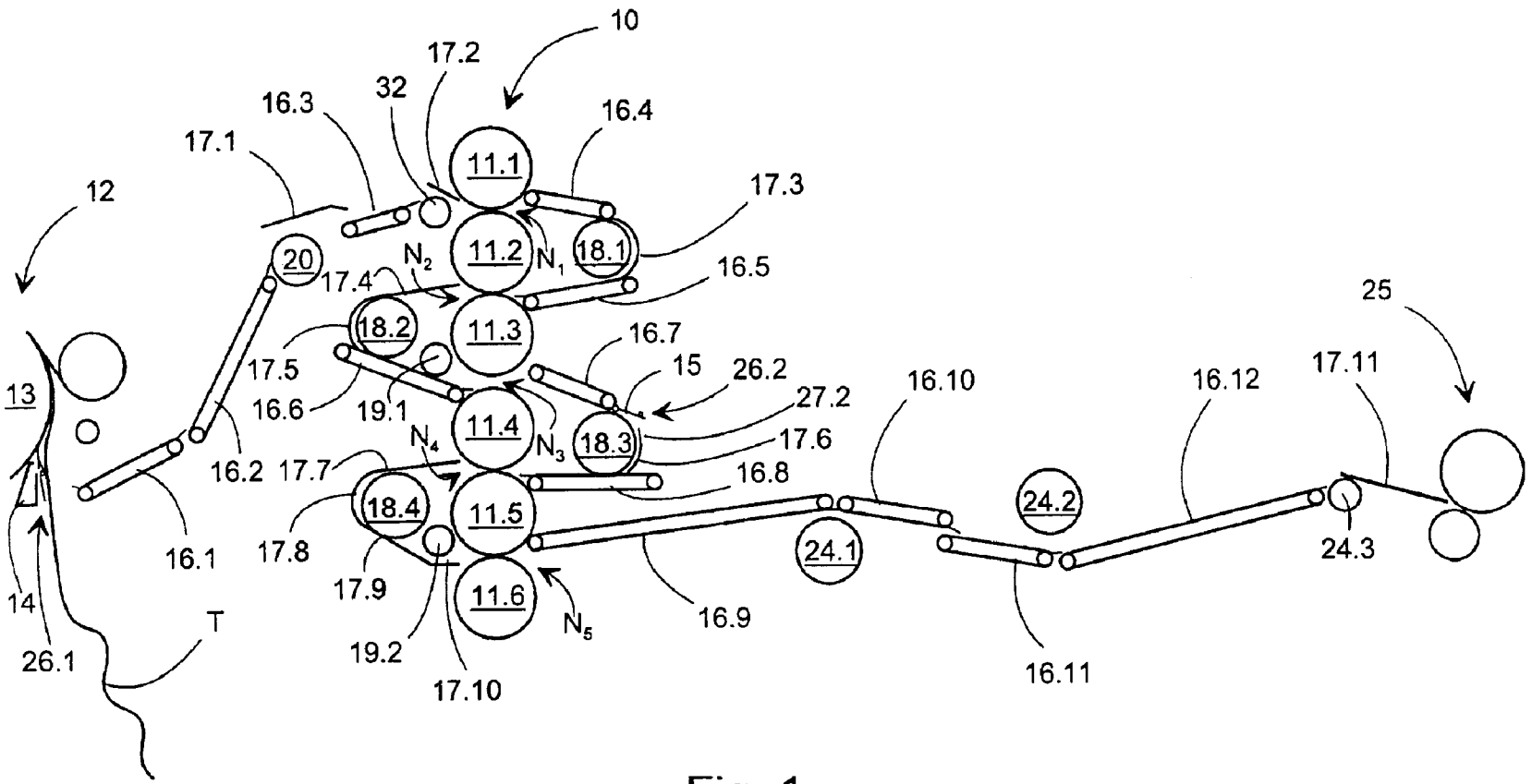
FIG. 1 shows one example of an embodiment of the method and apparatus according to the invention, prior to the commencement of the tail threading of the calender.
Figure 3:
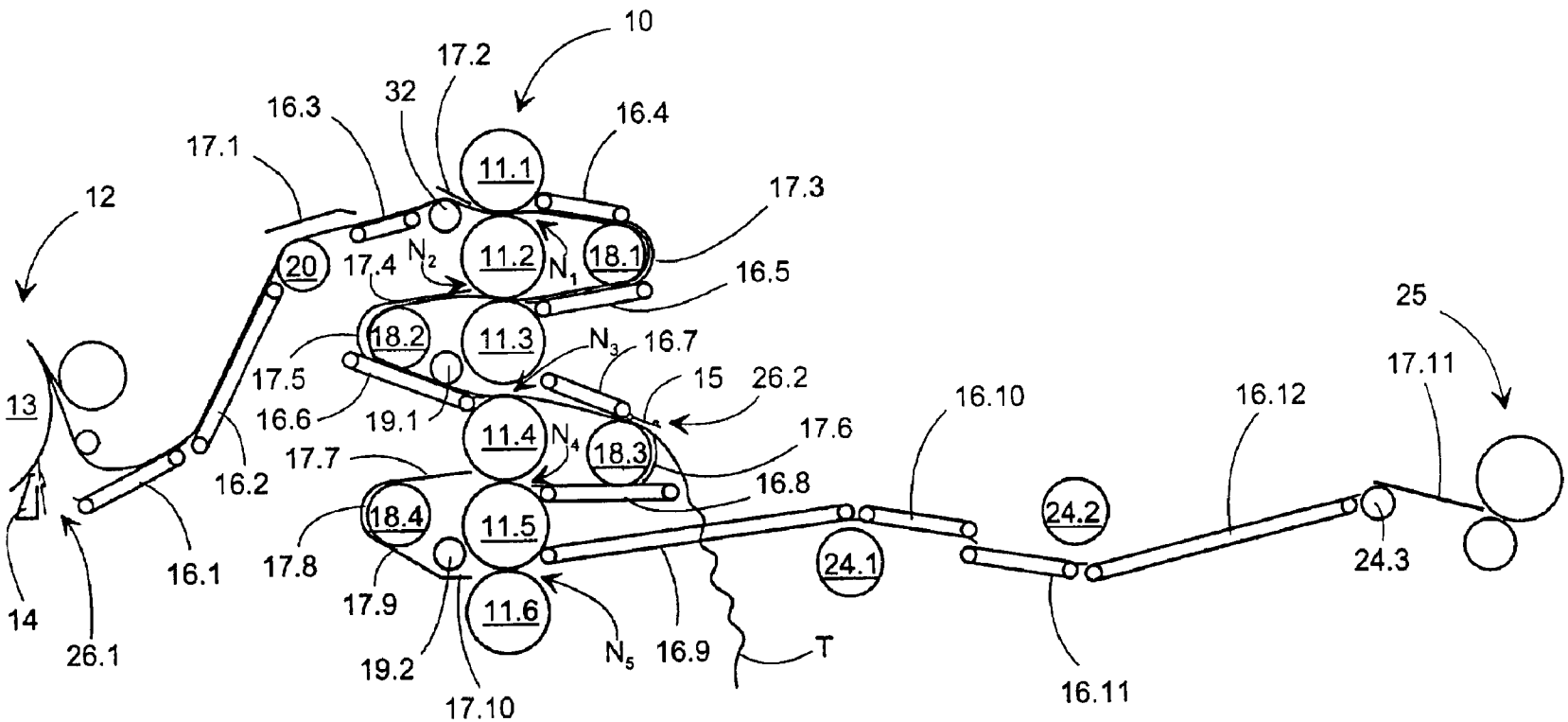
FIG. 3 shows one example of an embodiment of the method and apparatus according to the invention, in the first stage of the tail threading.
Figure 4:
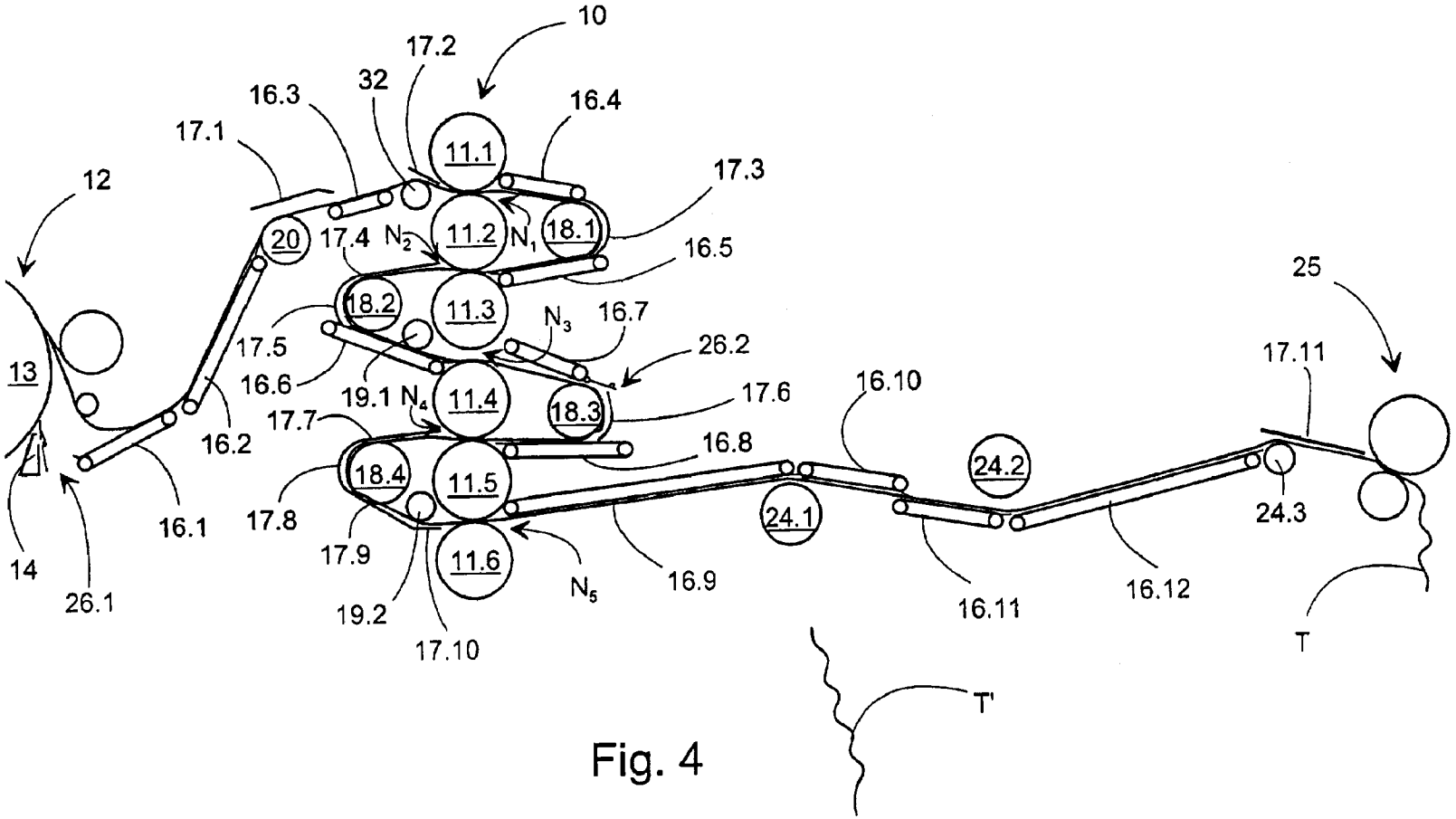
FIG. 4 shows one example of an embodiment of the method and apparatus according to the invention, in the second stage of the tail threading.

FIGS. 1, 3, and 4 shows an example of one ON-line multi-roll calender 10, which is thus arranged in connection with a paper machine. The multi-roll calender 10 can then be located, for example, after the drying section 12 or coater of the paper machine, and before, for example, the reeler 25.

The multi-roll calender 10 consists of an upper roll 11.1, a lower roll 11.6, and a set of rolls comprising intermediate rolls 11.2–11.5 between them. The rolls 11.1–11.6 of the roll set between them form calendering nips $N_1$–$N_5$. On two sides of the said rolls 11.1–11.6 there are spreader/take-off rolls 18.1–18.4, by means of which the paper web and the threading tail T are taken away from the surface of the calender rolls 11.1–11.6, between the nips $N_1$–$N_5$. Further, the calender 10 can include various auxiliary rolls 19.1, 19.2, 32, that guide the movement of the web.

In the method according to the invention, the guiding of the web threading tail T through the nips $N_1$–$N_5$ of the multi-roll calender 10 is carried out in stages. A stage is divided into several sub-operations, with the aid of which the tail threading is next described.

FIG. 1 shows the situation, from which the tail threading of the calender 10 is started. Before the multi-roll calender 10, a threading tail T is cut in a known manner at the end of the drying section 12, and at the same time the rest of the paper web is guided to the broke processing, which can be formed by, for example, a pulper or a suction tube arrangement (not shown). The guiding to the broke processing can thus also understand the guiding of the paper web or the threading tail T out of the calender 10, away from the normal running or tail threading path of the web or the threading tail T. The guiding to the broke processing thus takes place, for example, in such a way that the broke is brought to the processing manually using air blows.

This is followed as a sub-operation by the detachment of the threading tail T from the last roll 13 of the drying section 12, which can be carried out in various ways. Examples of these include the utilization of pick-up, blower plates, doctoring, a suction pipe, a high-pressure zone in the vacuum end of a roll, and variously sized rolls.

Figure 2:
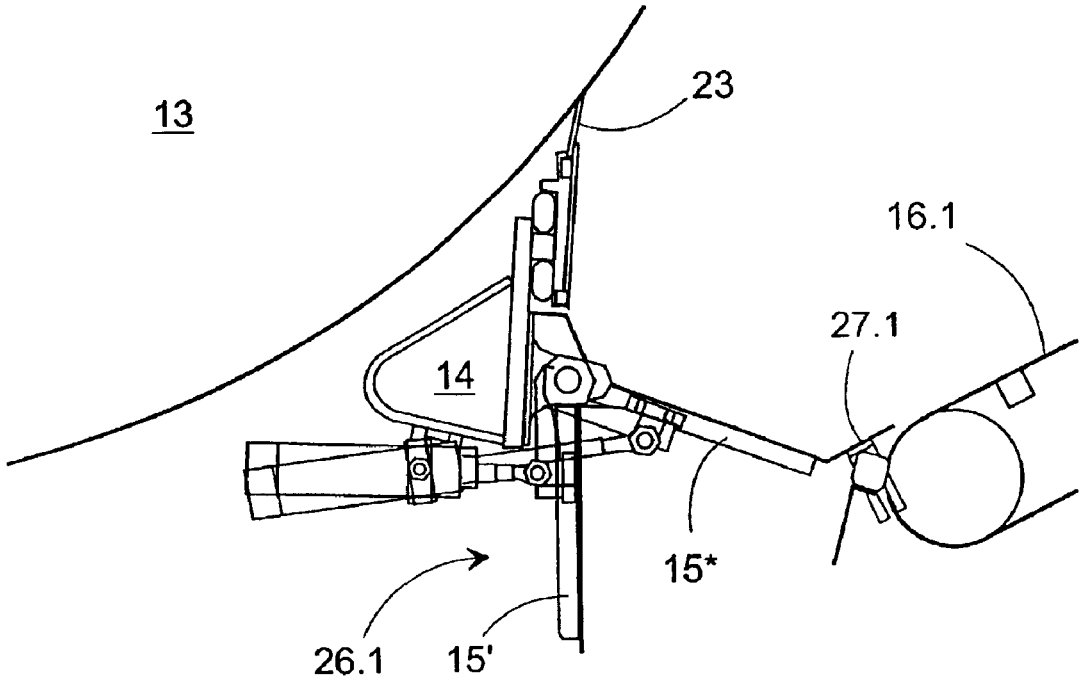
FIG. 2 shows one example of a cutting device.

FIG. 2 shows, for example, the detaching and cutting means 26.1 for the threading tail T, at the end of the drying section 12. A doctor blade 23 of the last roll 13 of the drying section 12 is used as the detaching element. The next sub-operation after detaching is cutting, which is carried out using a blade cutting device 26.1 arranged in connection with a doctor beam 14.

The blade of the cutting device 26.1 is shown in FIG. 2 in the cutting position, by the reference number 15*. When the threading tail T is being run to broke processing, the blade is in the position shown by the reference number 15'.

Figure 5:
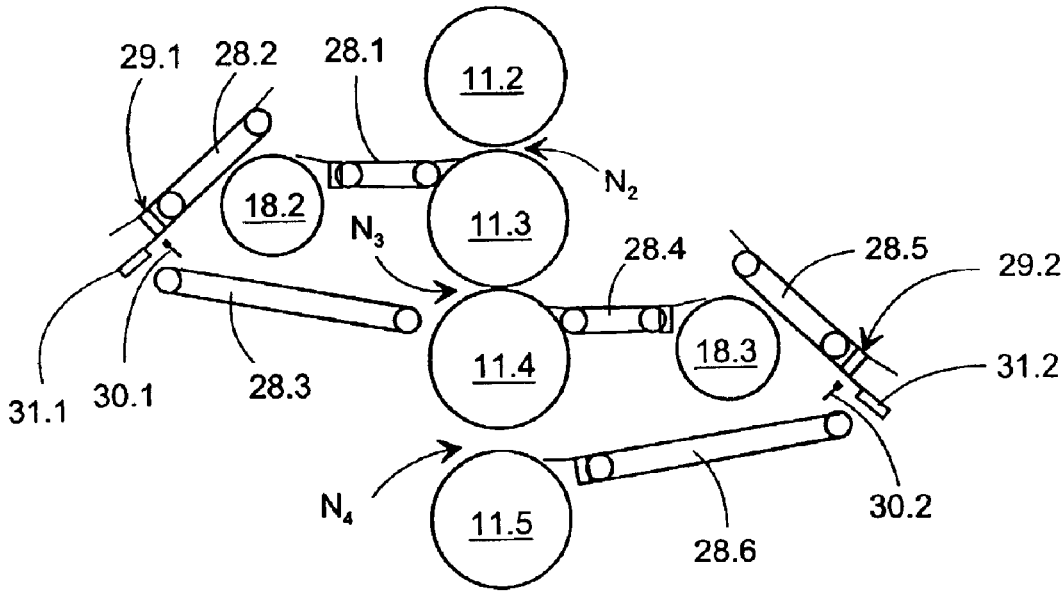
FIG. 5 shows a second example of the method and apparatus according to the invention in a calender.

The cutting device disclosed in FI publication 9901474, an embodiment of which is shown in FIG. 5, can be given as a second example of such a cutting device. Various pick-up implementations and other blade solutions can also be included.

The end of the threading tail T that cutting has created is caught, for example, by using a suction belt 16.1 and/or by blower plates 27.1 arranged in connection with it.

FIG. 3 shows the situation, in which the threading tail T has already been taken through several roll nips $N_1$–$N_3$. Once the threading tail T has been caught at the end of the drying section 12, transfer follows as the next sub-operation, which can take place, for example, using straight or curved threading/blower/guide plates 17.1–17.5, or suction belts 16.1–16.7. Several of the suction belts 16.1–16.3 can be set consecutively before the actual upper roll 11.1 of the calender 10. Further, there may also be guide rolls 20, 32 in this section.

In the ropeless tail threading method according to the invention in a multi-roll calender, the threading tail T is guiding from one nip to the next of the calender 10 using various guide and support elements. During threading, the set of rolls of the calender 10 is not under pressure and the rolls 11.1–11.6 are apart from each other. The element used can be, for example, suction belts 16.4–16.8 and straight or curved threading/blower/guide plates 17.3–17.10, i.e. coanda plates, the positions of which in the multi-roll calender 10 are shown in FIGS. 1, 3, and 4. In this case, the suction belts 16.4–16.8 and the plate elements 17.3 17.10 are located in the tail threading spaces between a nip $N_1$–$N_5$ and a take-off roll 18.1–18.4. The threading tail T can be guided using both high pressure and a vacuum. In this stage, the drives of the suction belts 16.1–16.7 and of the plate elements 17.1–17.5 are activated.

Transport around the take-off rolls 18.1–18.4, in which a large change in direction is imposed on the threading tail T, takes place, for example, using the curved plate elements 17.3, 17.5, 17.6, 17.8, shown in FIGS. 1, 3, and 4. Other ways are a suction end of the take-off roll 18.1–18.4, an auxiliary nip formed between a belt or auxiliary roll and take-off roll, and a nip based on the difference in friction between the lamellae and the roll (not shown).

The tail threading according to the method of the invention is thus carried out in stages, in which, during the threading, in connection with the calender 10, the threading tail T is sent to broke processing by running it out of the machine and cutting it at least once. After this, tail threading is continued, preferably after the successful conclusion of the previous stage.

The cutting device 26.2 in connection with the calender 10 can correspond to that shown in FIG. 2. It then includes, for example, a mechanical blade 15 for cutting the threading tail T and guide elements, such as a blower plate 27.2 for guiding the cut threading tail T to the following tail threading element 17.6, 16.8.

The cutting point can be selected freely. The cutting takes place after the selected nip $N_1$–$N_4$, between the first and the last nips $N_1$ and $N_5$. The nip can also include an auxiliary nip between a take-off roll 18.1–18.4 and an auxiliary roll (not shown) or a suction belt 16.4, 16.7, which acts as the holding point for the threading tail T. One criterion for defining the cutting point can be regarded as the point where the threading tail T begins to develop a double tail, and the need for its cutting, in order to achieve successful tail threading. In the example, the cutting device 26.2 is located, for example, in connection with the take-off roll 18.3 just below the midway point of the calender 10.

Before the cutting operation, the threading tail T is blown out of the calender 10 at this point and the tail T' is removed using a broke removing device, for example a suction device (not shown). If there is little broke T', it can also be blown onto the floor.

This is followed by the tensioning of the threading tail T, for which purpose the apparatus also includes a tensioning device arranged before the cutting device 26.2, which is preferably part of the tail threading element 16.7 preceding the cutting device 26.2.

FIG. 4 shows the situation, in which the double tail of the threading tail T has passed an intermediate cutting point and the tail T has been cut using the device 26.2. Next follows a sub-operation, in which the tail T is caught and blown to the transfer devices 17.5, 16.8 to move it to the following possible location of a take-off or broke processing, which may also be only at the reeler 25. The threading tail T can also be guided to the reeler 25 after the calender 10 using corresponding suction belts 16.9–16.12 and a threading plate 17.11. There can also be intermediate cutting points between the calender 10 and the reeler 25, where the stages specific to the method according to the invention are carried out. Further, there may also be guide rolls or similar 24.1–24.3 before the reeler 25. At this stage, the suction belts 16.1–16.7 and the plate elements 17.1–17.5 may already have ceased operating.

Once the threading tail T has been successfully threaded through the calender 10, for example, as far as the reeler 25, the web is spread to its full width and tensioned, after which the nips $N_1$–$N_5$ of the set of rolls can be closed.

The threading tail T can be begun to be run out of the machine and cut at at least two points after the nips $N_1$–$N_4$ formed by the rolls 11.1–11.6 of the multi-roll calender 10, in which case a cutting device 26.2 will also be located after each nip $N_1$–$N_4$.

FIG. 5 shows a partial view of a second embodiment of a multi-roll calender implementing the method and apparatus according to the invention, in which cutting takes place after each nip. In this case, it is precisely the cutting device 29.1, 29.2 disclosed in the FI publication 9901474 that is used. The threading tail is arranged to be run out using an ejector pipe 31.1, 31.2, so that there is no need for extensive pulper arrangements. The catching of the tail takes place in this example by means of rotatable blower plates 30.1, 30.2 and the transfer by means of suction belts 28.1–28.6.

In the method according to the invention, each stage thus includes, as sub-operations, at least the reception of the threading tail T, and its transfer, running out, and cutting.

The intermediate cutting referred to and the transfer to the following sub-operation can take place manually, or preferably in an automated manner, in which case the amount of broke T' will remain small, due to the shortness of the double tail and it can easily be blown, for example, onto the floor of the machine hall, from where it can easily be forwarded, for instance, manually to the broke processing. In that case, there is no need to arrange separate broke processing in connection with the calender 10.

In place of or along with the suction belts 16.4–16.8, it is possible to use threading/blower/guide plates or auxiliary rolls. It is, however, preferable if there is a suction belt and not a plate element on either side of the cutting point, as this will transfer the threading tail T more reliably.

There is no restriction to the width of the suction belts, but they are preferably adapted to the width of the threading tail T. There are also several alternative tail threading paths. The threading can now be easily carried out, for example, directly through the lower nip $N_5$, which cannot be, at least easily, carried out using known rope threading, due to the fixed position of the rope structures next to the calender 10. This permits the calender processing required by the needs of the different paper grades at different times and also saves the rolls 11.1–11.6.

Although the invention has been described by reference to a specific embodiment, it should be understood that numerous changes may be made within the spirit and scope of the inventive concepts described. Accordingly, it is intended that the invention not be limited to the described embodiment, but that it have the full scope defined by the language of the following claims.

What is claimed is:

1. A method of ropeless tail threading for a multi-roll calender, wherein a threading tail is cut off at a first broke processing before being guided through the multi-roll calender, the method characterized in that the tail threading in connection with the multi-roll calender takes place in stages including a first sub-stage of guiding the threading tail to a second broke processing and a second sub-stage of cutting off the threading tail, wherein during said tail threading in connection with the multi-roll calender, tail threading is continued after the cutting off sub-stage.

2. A method according to claim 1, characterized in that the threading tail is guided to the second broke processing and cut off after a nip formed by the rolls of a multi-roll calender.

3. A method according to claim 2, characterized in that each stage includes sub-stages of at least receiving the threading tail, transferring the threading tail, guiding the threading tail to the second broke processing, and cutting off the threading tail.

4. A method according to claim 2, characterized in that, before being cut off, the threading tail is tensioned.

5. A method according to claim 2, characterized in that the threading tail is guided using both high pressure and a vacuum.

6. An apparatus adapted for ropeless tail threading in a multi-roll calender, which apparatus includes consecutive ropeless tail threading elements for guiding a threading tail through nips formed by rolls of the multi-roll calender, the tail threading elements guiding the threading tail from previous tail threading elements of the multi-roll calender to following tail threading elements, the apparatus characterized by a cutting device arranged in connection with the multi-roll calender before the last nip for cutting off the threading tail to end a tail threading stage; and another tail threading element after said cutting device for starting a next tail threading stage.

7. An apparatus according to claim 6, characterized in that the apparatus further includes a tensioning device, arranged before the cutting device.

8. An apparatus according to claim 6, characterized in that the cutting device includes both a blade for cutting the threading tail and guide elements for guiding the cut threading tail to the following tail threading element.

9. An apparatus according to claim 6, characterized in that the tail threading elements are blower/threading plates and/or suction belts.

10. An apparatus according to claim 6, characterized in that the cutting device is located after at least two nips.

11. An apparatus according to claim 7, characterized in that the said tensioning device is part of the tail threading element preceding the cutting device.

* * * * *